US005224539A

United States Patent [19]

Lifshits

[11] Patent Number: 5,224,539

[45] Date of Patent: Jul. 6, 1993

[54] COOLING SYSTEM FOR AIR HEATERS AND THE LIKE

[75] Inventor: Vladimir Lifshits, Palo Alto, Calif.

[73] Assignee: Coen Company, Inc., Burlingame, Calif.

[21] Appl. No.: 715,167

[22] Filed: Jun. 14, 1991

[51] Int. Cl.[5] ..... F28F 3/12; F27D 1/12

[52] U.S. Cl. ..... 165/169; 165/904; 60/753; 431/353; 432/238

[58] Field of Search ..... 165/169, 904; 431/350, 431/353; 60/752, 753; 432/81, 237, 238

[56] References Cited

U.S. PATENT DOCUMENTS

| | | | |
|---|---|---|---|
| 1,360,587 | 11/1920 | Said | 432/65 |
| 1,698,313 | 1/1929 | Luther | 432/116 |
| 1,897,808 | 2/1933 | Kinney | 431/114 |
| 2,112,743 | 3/1938 | Poole | 165/185 |
| 2,132,710 | 10/1938 | Vanderwerp | 432/105 |
| 2,179,635 | 11/1939 | Kimmel | 432/238 |
| 2,428,993 | 10/1947 | Reichelderfer | 165/156 |
| 2,503,595 | 4/1950 | Preston | 165/162 |
| 2,548,485 | 4/1951 | Lubbock | 432/238 |
| 2,814,470 | 11/1957 | Peterson | 165/170 |
| 2,868,514 | 1/1959 | Hodson et al. | 165/170 |
| 2,870,998 | 1/1959 | Woolard | 165/170 |
| 2,877,007 | 3/1959 | Risse | 432/103 |
| 3,016,695 | 1/1962 | Lovingham | 165/169 |
| 3,074,469 | 1/1963 | Babbitt et al. | 431/353 |
| 3,181,605 | 5/1965 | Smith | 165/170 |
| 3,232,344 | 2/1966 | Anderson et al. | 165/170 |
| 3,254,643 | 6/1966 | Thomason | 165/904 |
| 3,456,935 | 7/1969 | Bornor | 432/81 |
| 3,794,462 | 2/1974 | Sylvest | 432/80 |
| 3,915,627 | 10/1975 | Foy | 432/105 |
| 3,918,893 | 11/1975 | Whitaker | 432/103 |
| 4,108,241 | 8/1978 | Fortini et al. | 165/169 |
| 4,235,173 | 11/1980 | Sharp | 110/336 |
| 4,453,475 | 6/1984 | Floger | 110/336 |
| 4,642,993 | 2/1987 | Sweet | 60/752 |
| 4,836,775 | 6/1989 | Heithoff et al. | 432/112 |
| 4,838,031 | 6/1989 | Cramer | 60/753 |

FOREIGN PATENT DOCUMENTS

| | | | |
|---|---|---|---|
| 694374 | 7/1940 | Fed. Rep. of Germany . | |
| 734395 | 3/1943 | Fed. Rep. of Germany . | |
| 2413250 | 10/1975 | Fed. Rep. of Germany | 165/154 |
| 2413381 | 10/1975 | Fed. Rep. of Germany | 165/142 |
| 1439132 | 11/1988 | U.S.S.R. . | |
| 315540 | 7/1929 | United Kingdom | 432/238 |

*Primary Examiner*—John Rivell
*Assistant Examiner*—L. R. Leo
*Attorney, Agent, or Firm*—Townsend and Townsend, Khourie and Crew

[57] ABSTRACT

A cooling system including a cooling duct adjacent to the hot air duct of an air heater. The cooling duct includes a first wall and a second wall spaced from the first wall such that a passageway is formed therebetween. A wire mesh sheet is arranged in the duct passageway. The wire mesh sheet comprises a plurality of layers of wire mesh and has an undulate configuration which together with its density prevents substantial heat radiation from the first wall of the cooling duct to the second wall without significantly impeding airflow through the cooling duct. Cooling air introduced into the cooling duct flows through the duct, removes heat, radiated by the first wall and absorbed by the wire mesh sheet, and carries that heat away from the duct as it exits through the outlet opening. In this way, the system cools the first wall and prevents any significant heat transfer to the second wall of the cooling duct and elements in the vicinity thereof.

27 Claims, 3 Drawing Sheets

COOLING SYSTEM FOR AIR HEATERS AND THE LIKE

BACKGROUND OF THE INVENTION

The present invention relates to heat exchangers generally, and more particularly to a cooling system suitable for use in conjunction with variously configured air heaters, burner combustion chambers and the like.

Air heaters are often used in conjunction with dryers. For example, a known large industrial slurry dryer is shown in FIG. 1 in conjunction with a ring-shaped type air heater. In such a device, the dryer assembly 1 includes a funnel-shaped housing 2 from which slurry pump and atomizer 3 discharge the slurry from the small diameter end of rotating nozzle 4. The slurry is sprayed into a drying space 5 where the slurry is dried and the dried particles 6 gravitationally drop into a hopper (not shown) for removal. Hot 700°–1000° C. gas-air from plenum 8, flows through annular opening 9, and along the conical outside of housing 2 through conical ring duct 10. The hot gas-air then exits hot air duct 10 as it is directed toward the slurry discharge opening of nozzle 4 where it is mixed with the atomized slurry to drive off the water.

When temperatures in the system illustrated in FIG. 1 exceed about 800° C., which can occur, for example, when a burner is positioned immediately upstream of air duct 10, concerns arise in protecting the duct walls from excessive heat flux. Specifically, mechanical properties (e.g., strength) of the heat resistant steel used to construct the duct walls generally deteriorate at these temperatures. This generally leads to problems in the structural integrity of the system and eventual warping.

Typically, refractory material is used to protect surfaces of air heaters, furnaces, combustion chambers and the like, which are subject to such temperatures, i.e., temperatures in excess of about 800° C. A layer of refractory also protects these surfaces against direct flame exposure. However, the use of refractory has certain drawbacks. Specifically, refractory is susceptible to breakdown and cracking which can result in contamination of the heated air exiting the air heater and, thus, contamination of the product to be dried. Refractory is especially susceptible to cracking when formed in certain configurations such as the conical configuration of the outer wall of housing 2. Thus, although plenum 8 may possibly be lined with refractory, it has been found clearly undesirable to line funnel-shaped walls 11 with refractory material.

When air cooled or water cooled heat exchangers are used to maintain the heater duct walls at a reasonable temperature, concerns arise relating to energy efficiencies. Conventional air cooled systems include a plurality of tubes through which air is forced at a velocity such that there is sufficient heat transfer from the duct wall of the air heater. Generally, these air flow velocities are accompanied with substantially high pressure drops and, thus, relatively high energy consumption.

Energy losses also occur with conventional water cooled heat exchangers (e.g., a water jacket type heat exchanger). In water cooled systems, heat transfers from the working surface, e.g., the duct walls of an air heater, to the water in the heat exchanger. Since the heat lost to the water is not recovered and returned to the air exiting the air heater (such recovery being essentially impractical), energy is lost from the system. In addition, these water cooling systems are undesirable due to high initial and subsequent maintenance costs. For example, these systems generally require expensive water treatment systems to minimize corrosion and plugging of the water conduits.

SUMMARY OF THE INVENTION

The present invention is directed to a cooling system for an air heater that avoids the problems and disadvantages of the prior art. This goal is accomplished by providing a cooling duct adjacent to the hot air duct (or combustion chamber) of an air heater as described hereafter. The cooling duct includes a first wall and a second wall spaced from the first wall such that a passageway is formed therebetween. The first wall can form a portion of or be adapted to be coupled to the outer wall of the hot air duct of the air heater. A wire mesh sheet is arranged in the duct passageway. The wire mesh sheet comprises several layers of wire mesh and has an undulate configuration which together with its density prevents substantial heat radiation from the first wall of the cooling duct to the second wall without significantly impeding airflow through the cooling duct. Cooling air introduced into the cooling duct flows through the duct, removes heat radiated by the first wall and absorbed by the wire mesh sheet, and carries that heat away from the duct as it exits through an outlet of the duct. This energy efficient cooling system thus cools the first wall and protects it from extreme heat flux. The system also prevents undesirable amounts of heat from being transferred to elements surrounding the air heater, e.g., the second wall which may, for example, surround a slurry that must remain sufficiently fluid in order to be atomized.

In addition to acting as a cooling system, the duct cooler can be used as an air heater. By keeping the hot air exiting from the cooling duct separate from the hot combustion air in the combustion chamber, noncontaminated, hot air is generated. Thus, the above-described cooling system also can be used as a system for heating air.

The above is a brief description of some deficiencies in the prior art and advantages of the present inventions. Other features, advantages and embodiments of the invention will be apparent to those skilled in the art from the following description, accompanying drawings and appended claims.

DESCRIPTION OF THE PREFERRED EMBODIMENT

Figure 1:
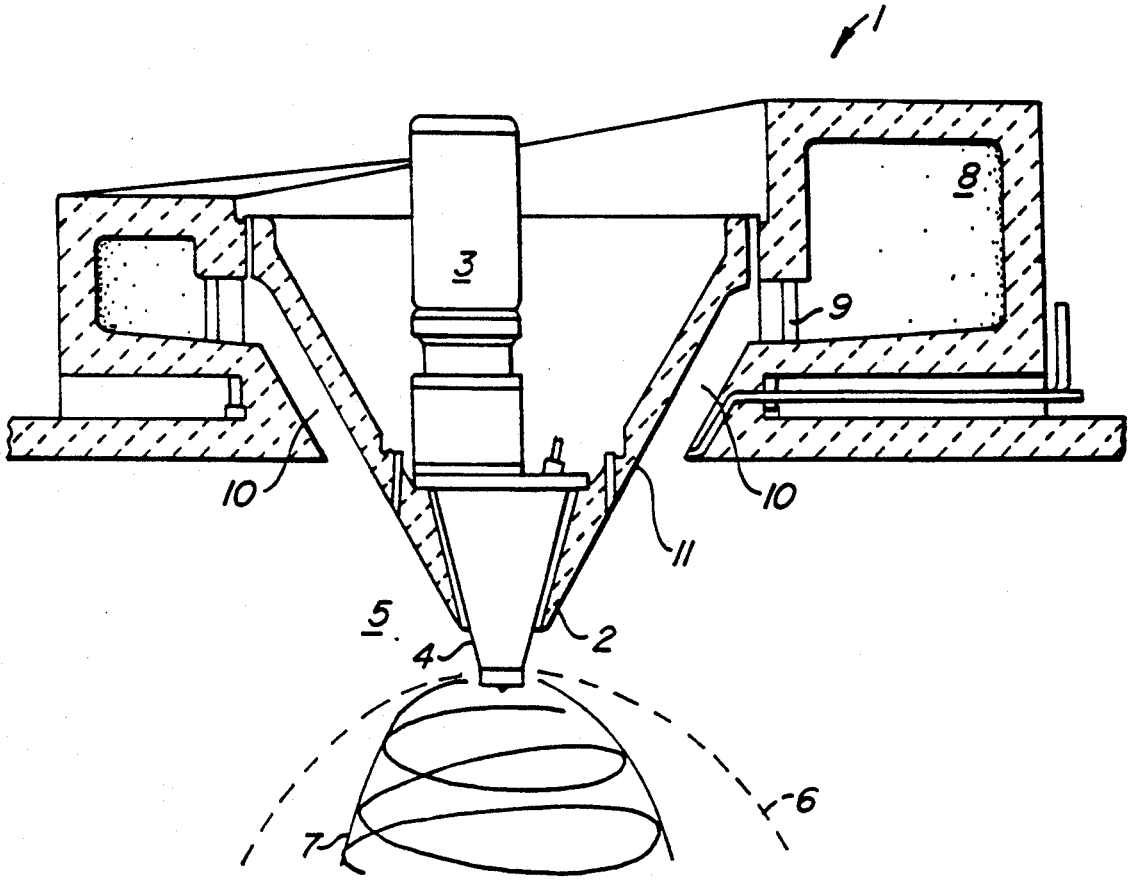
FIG. 1. PRIOR ART
FIG. 1 is a diagrammatic illustration of a typical funnel-shaped prior art industrial dryer.
Figure 2:
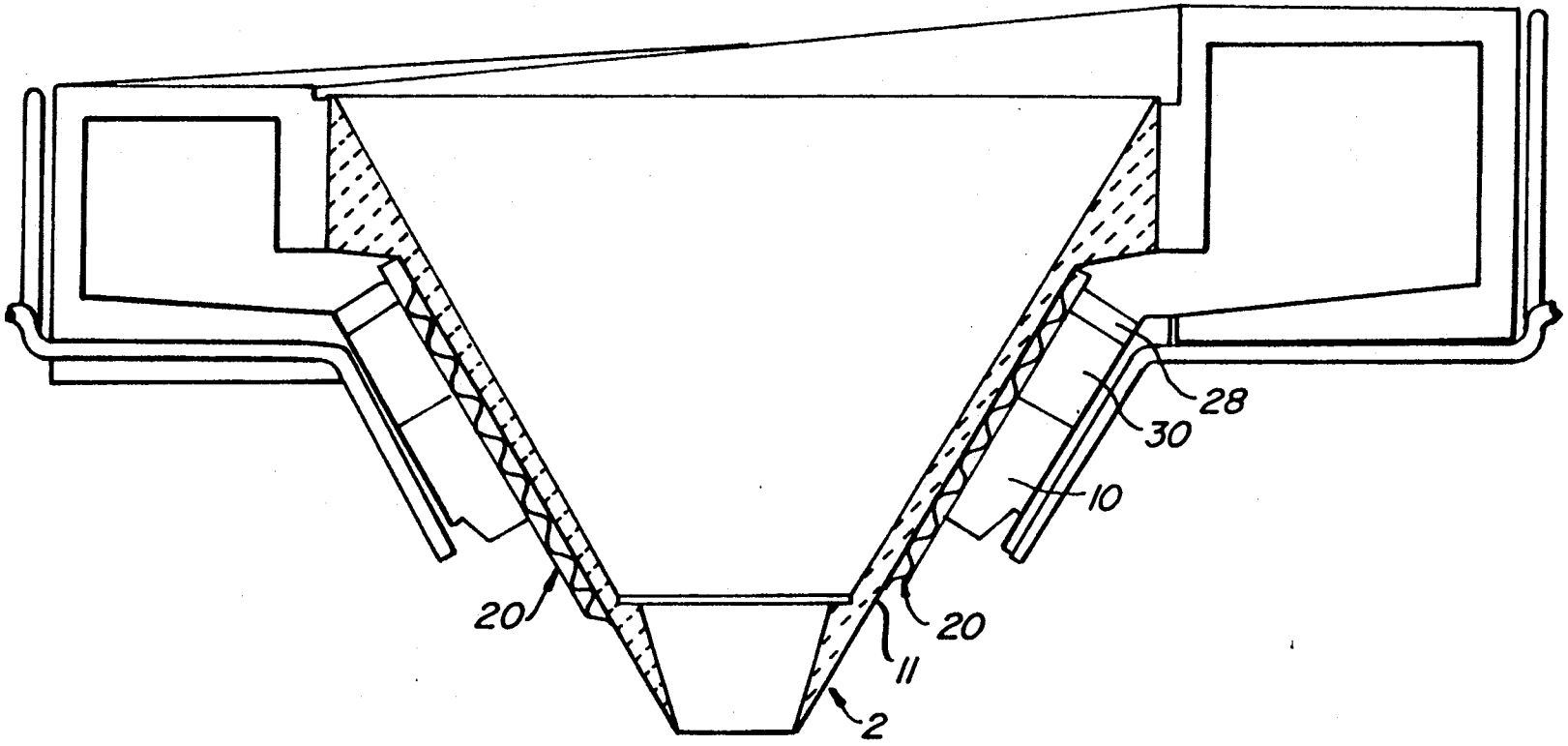
FIG. 2 is a diagrammatic illustration of a funnel-shaped dryer having a cooling system coupled to an air heater duct in accordance with the principles of the present invention.
Figure 3:
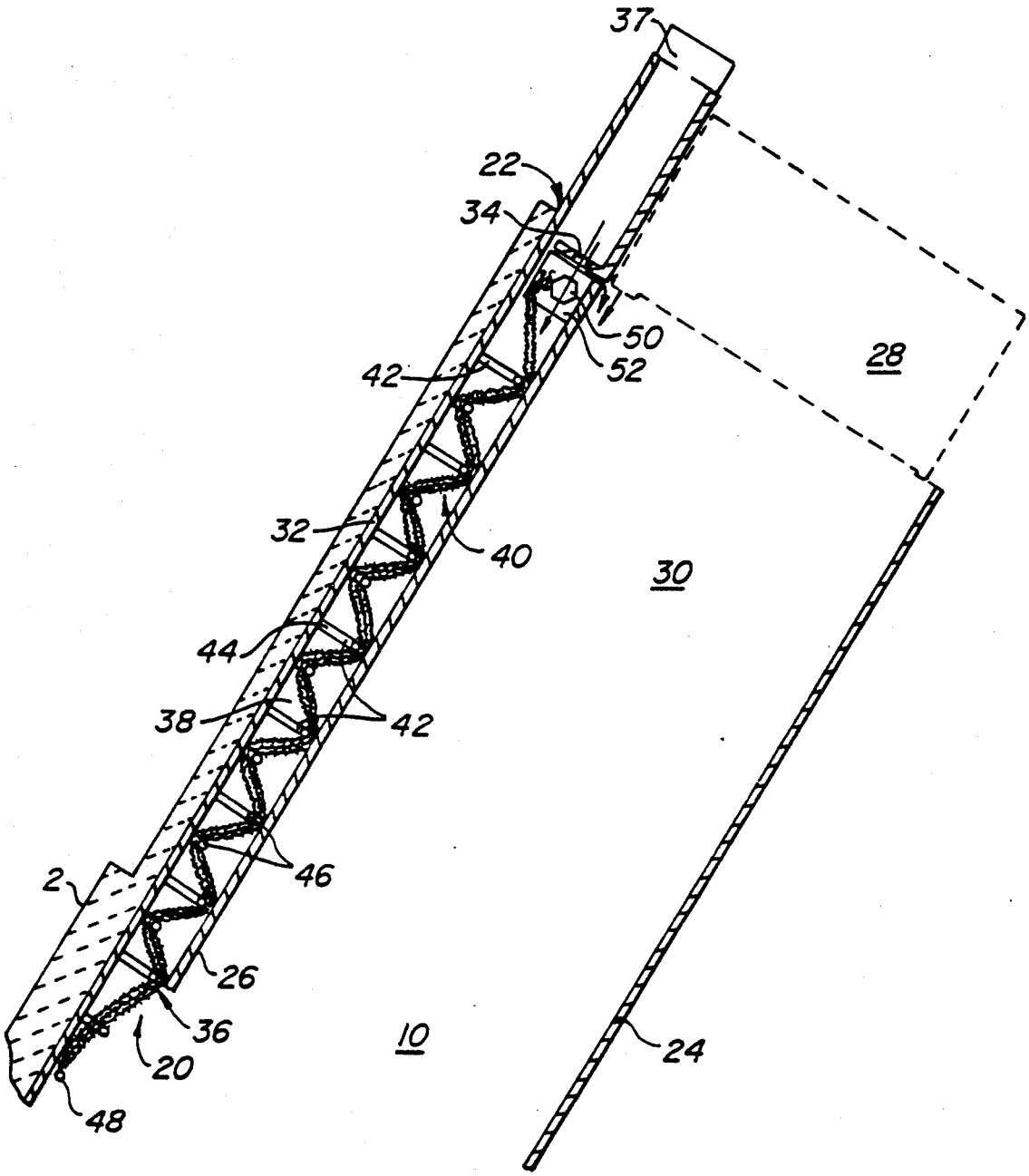
FIG. 3 is an enlarged view of the air heater duct and cooling system of FIG. 2.

Referring to the drawings in detail wherein like numerals indicate like elements, the cooling system is illustrated in accordance with the principles of the present invention in FIGS. 2 and 3. Although the cooling system, designated with reference numeral 20, is described in conjunction with the cone-shaped housing of a slurry dryer, it has applicability to any surface one might wish to cool such as, for example, horizontal, inclined or vertical walls of an air heater such as an industrial furnace.

Referring to FIG. 2, cooling system 20 includes cooling duct 22 which is located on the outside of funnel-shaped housing 2 and faces frustoconical air heater duct 10. Hot air duct 10 includes an outer conical wall 24 and an inner conical wall 26 which are radially spaced to form a hot air passageway therebetween. A source for providing high temperature air in the air heater duct is provided as is conventional in the art. For example, a commercially available duct burner and ignitor for generating a flame can be configured and coupled to the upstream portion of air heater duct 10 as is diagrammatically shown and designated with reference numeral 28. Burner 28 provides the appropriate combustion mixture to combustion chamber portion 30 of duct 10.

Cooling duct 22 is defined by a pair of conical plates that are radially spaced apart to form a fluid passageway therebetween. The conical plates preferably are metal. Referring to FIG. 3, cooling duct 22 is illustrated as being defined by conical plate or wall 32 and conical plate or wall 26 which also defines the inner wall of air heater duct 10. However, it should be understood that other arrangements can be used without departing from the scope of the invention. For example, cooling duct 22 can have an outer wall that is separate from, but coupled to inner wall 26 of heater duct 10. It should also be understood that another cooling duct (not shown) that is similar to cooling duct 22 can be coupled to outer wall 24 for cooling wall 24. Returning to FIG. 3, cooling duct 22 also includes cooling air inlet opening 34 at its upstream end and air outlet 36 at the downstream end thereof. A source for introducing cooling air into intake opening 34 can be provided as is conventional and well known to those skilled in the art. Such a source is diagrammatically illustrated and designated with reference numeral 37.

Within passageway 38 of cooling duct 22 is an undulating radiation-convection heat exchanger 40 which is defined by multiple (e.g., 3 or 4) layers of wire mesh each preferably having substantially the same thickness. The average distance between adjacent layers is at least about twice the average thickness of any one layer of wire mesh to provide the desired hydraulic efficiencies with respect to air flow through heat exchanger 40. The spacing naturally results from the above-described heat exchanger construction and the generally non-flat character of commercially available wire mesh, i.e., the wire mesh layers are not exactly parallel when placed one over the other. Preferably, the wire mesh layers also have the same undulate shape. Although the preferred embodiment is illustrated with rounded crests and troughs, other configurations can be used. For example, each layer can have spiked crests and troughs.

Holders or anchors 42 are provided throughout the inside of annular duct 22 for suspending wire mesh sheet 40 which includes a plurality of layers (sheets) of wire mesh as discussed above. Holders 42 are in the form of L-shaped hooks and have one portion (designated with reference numeral 44) secured to inner wall 32 of duct 22 and another portion (designated with reference numeral 46) over which the wire mesh sheet is suspended. Wire mesh sheet 40 is simply draped over and under the holders such that holders 42 suspend or loosely support wire mesh sheet 40 in a sinuous or undulate configuration. If desired, the upper and lower margins of wire mesh sheet 40 can be secured in position by a pin 48 and a bolt 50 which engages a radial plate 52.

In operation, heat from the flame generated in combustion chamber 30 heats duct plate 26 which in turn radiates heat toward inner cone plate 32. The wire mesh sheet is arranged and constructed such that very little heat radiation reaches inner cone plate 32. First, substantially all, i.e., a major portion of the heat radiated from duct wall 26, is absorbed by the wire mesh sheet 40. Then, the air that is introduced through inlet 34 flows over and around the individual wires of the wire mesh sheet and toward outlet 36. Heat, radiated from inner plate 26 and absorbed by wire mesh sheet 40, is thereby transferred to the cooling air by convection. In this way, wall 26 of air heater duct 10 is cooled, and inner wall 32 along with funnel-shaped housing 2 are protected from undesirable heat flux, while heated air is exhausted from air outlet 36. The air discharged from outlet 36 rejoins and mixes with the hot gas flowing from the combustion chamber toward the slurry discharge opening in the funnel-shaped housing. In this way, heat removed from the walls of duct 10 is returned to the system, thereby minimizing energy losses.

In the illustrated embodiment, the wire mesh is made of carbon steel with a maximum wire diameter of about 1 millimeter. Sufficient layers of wire fabric, comprising unaligned interwoven wire, are placed over each other so that no more than about 10% of the radiation heat flux from air heater duct plate 26 reaches the inner cooling duct plate 32 (i.e., about 90% of the heat flux is absorbed by the wire mesh sheet). It has been found that wire mesh sheet having 3 to 4 layers of wire mesh, with each layer having a porosity of about 70–80% and a thickness of about 2 mm, provides the desired heat transfer characteristics. It is noted that the mesh thickness is greater than the wire thickness due to the interwoven mesh construction.

Of particular importance is the undulating arrangement of the wire mesh sheet as it facilitates the airflow through the mesh and minimizes temperature gradient in airflow cross section, as different portions of the airflow cross approximately the same number of different wire layers in their movement along the duct. Since the convection heat transfer coefficient for thin wires is relatively high (typically one to two orders more than that associated with other surfaces), relatively low air velocities can be used to cool the wires. Lower air velocities result in a relatively small pressure drop, which, in turn, improves energy efficiencies. For example, for a one-meter duct length and an airflow speed of about 5 meters per second (typical), the pressure drop is only about 1.5 inches of water column.

Another advantage of this arrangement is a uniformity of cooling intensity, as a major radiation component of heat flux from hot plate 26 is not sensitive to the local mesh and air temperatures in a wide range of parameters.

In addition to acting as a cooling wall, the duct cooler can be used as an air heater. By keeping the hot air exiting from the outlet of the duct separate from the hot combustion air in the combustion chamber, noncontaminated, hot air is generated. Thus, the above-described cooling system also can be used to generate noncontaminated, hot air.

For high combustion chamber temperatures, such as encountered in the above-mentioned slurry dryer, duct plate 26 is made of heat resistant steel, or similarly high quality material, and to prevent deformation, buckling, etc., it is relatively thick, e.g., $\frac{3}{8}$–$\frac{1}{2}$ inch for a cone diameter of about 3–3.5 meters. Duct plate 26 also is preferably annular in configuration, e.g., frustoconical or cylindrical. Since this configuration is without corners, a uniform heat flux can be conducted through duct plate 26 and radiated to the cooling system.

The above is a detailed description of a particular embodiment of the invention. It is recognized that departures from the disclosed embodiment of the invention may be made within the scope of the invention and that obvious modifications will occur to a person skilled in the art. The full scope of the invention is set out in the claims that follow and their equivalents. Accordingly, the claims and specification should not be construed to unduly narrow the full scope of protection to which the invention is entitled.

What is claimed is:

1. A cooling system for an air heater, said cooling system comprising:

a duct having a first wall adapted to form a portion of an air heater, a second wall spaced from said first wall to form a passageway therebetween, an inlet opening and an outlet opening; and a wire mesh sheet loosely suspended in said duct passageway, said wire mesh sheet having an undulate configuration and construction such that said wire mesh sheet absorbs at least about 90% of the heat radiated from said first wall;

whereby cooling air introduced into said duct inlet opening flows through the duct, removes heat, radiated by the first wall and absorbed by the wire mesh sheet, and carries that heat away from the duct as it exits through said outlet opening thereby preventing significant heat transfer from said first wall to said second wall.

2. The cooling system of claim 1 wherein said undulate wire mesh sheet forms crests and troughs, said crests being positioned adjacent to said first wall and said troughs being positioned adjacent to said second wall.

3. The cooling system of claim 1 wherein said undulate wire mesh sheet comprises wire strands, each wire strand having a maximum diameter of about 1 mm.

4. The cooling system of claim 3 wherein said wire strands are unaligned.

5. The cooling system of claim 3 wherein said wire strands comprise carbon steel.

6. The cooling system of claim 3 wherein said wire mesh sheet comprises a plurality of layers of wire mesh.

7. The cooling system of claim 6 wherein said wire mesh sheet comprises up to 4 layers of wire mesh.

8. The cooling system of claim 7 wherein each layer has a porosity of about 70–80%.

9. The cooling system of claim 8 wherein each layer is about 2 mm thick.

10. The cooling system of claim 1 wherein said undulate wire mesh sheet comprises a plurality of layers of wire mesh.

11. The cooling system of claim 10 wherein adjacent layers of wire mesh include portions that contact one another and portions that are spaced from one another, said portions being arranged such that the average distance between adjacent layers is at least about two times the average wire mesh thickness.

12. The cooling system of claim 1 further including means for suspending said wire mesh sheet in said undulate configuration.

13. The cooling system of claim 12 wherein said suspending means comprises a plurality of anchors, each anchor having a first portion in contact with said wire mesh sheet and a second portion coupled to one of said walls.

14. The cooling system of claim 13 wherein the first portion loosely supports the wire mesh sheet.

15. The cooling system of claim 14 wherein the second portion is affixed to one of said walls.

16. The cooling system of claim 1 further including means for introducing cooling air into the inlet opening of said duct.

17. The cooling system of claim 1 wherein said duct is annular and said wire mesh sheet extends substantially throughout said duct.

18. The cooling system of claim 17 wherein said first wall has a first surface forming an interior portion of said duct and a second surface forming an exterior portion of said duct, said second surface being annular.

19. A cooling system comprising:

a duct having first and second walls that are spaced apart to form a passageway therebetween, the first wall being adapted to be heated, said duct further including an inlet opening and an outlet opening;

an undulate wire mesh sheet comprising a number of layers of wire mesh, said wire mesh sheet being loosely supported in the passageway of said duct, the number of layers of wire mesh being selected such that said wire mesh sheet absorbs at least about 90% of the heat radiated from said first wall to prevent a significant amount of heat radiated from said first wall from reaching the second wall; and an air source coupled to said inlet opening for introducing cooling air into said duct, whereby cooling air introduced into the duct flows over and through the undulate wire mesh sheet, removes heat from said sheet and carries that heat away from the duct as it exits through the outlet opening.

20. The cooling system of claim 19 including means for heating said first wall, said heating means comprising a combustion chamber that is contiguous with said first wall.

21. The cooling system of claim 20 further including means for generating a flame in said combustion chamber.

22. The cooling system of claim 19 wherein said layers of wire mesh comprise wire strands having a maximum diameter of about 1 mm.

23. A cooling system comprising:

a duct having first and second metal wall that are spaced apart to form a passageway therebetween, the first wall being adapted to be heated and having an inner surface facing said second wall, said inner surface being substantially exposed to enhance heat radiation from said first wall into said duct, said duct further including an inlet opening and an outlet opening;

an undulate wire mesh sheet comprising multiple layers of wire mesh, said wish mesh sheet being supported in said duct passageway without being directly secured to said duct walls, said wire mesh sheet forming means for absorbing at least about 90% of the heat radiated from said first wall to prevent a significant amount of heat radiated from said first wall from reaching the second wall; and an air source coupled to said inlet opening for introducing cooling air into said duct, whereby cooling air introduced into the duct flows over and through the undulate wire mesh sheet, removes heat from said sheet and carries that heat away from the duct as it exits through the outlet opening.

24. The cooling system of claim 23 including means for heating said first wall, said heating means comprising a combustion chamber that is contiguous with said first wall.

25. The cooling system of claim 24 wherein said wire mesh sheet comprises a plurality of layers of wire mesh.

26. A cooling system for an air heater, said cooling system comprising:

a duct having a first wall adapted to form a portion of an air heater, a second wall spaced from said first wall to form a passageway therebetween, an inlet opening and an outlet opening;

a wire mesh sheet arranged in said duct passageway and having a constructing such that said wire mesh sheet absorbs a substantial amount of heat radiated from said first wall; and a plurality of anchors, each anchor having a first portion and a second portion, said first portions loosely supporting said wire mesh sheet in an undulate configuration, and said second portions being coupled to one of said walls;

whereby cooling air introduced into said duct inlet opening flows through the duct, removes heat, radiated by the first wall and absorbed by the wire mesh sheet, and carries that heat away from the duct as it exits through said outlet opening thereby preventing substantial heat transfer from said first wall to said second wall.

27. The cooling system of claim 26 wherein said second portions are affixed to one of said walls.

* * * * *